US006059594A

United States Patent [19]

Davis et al.

[11] Patent Number: 6,059,594

[45] Date of Patent: May 9, 2000

[54] SEALED ELECTRICAL CONNECTOR

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 09/183,174

[22] Filed: Oct. 30, 1998

[51] Int. Cl.[7] ..... H01R 13/52

[52] U.S. Cl. ..... 439/275; 439/936

[58] Field of Search ..... 439/275, 274, 439/271, 281, 272, 587, 936

[56] References Cited

U.S. PATENT DOCUMENTS

| | | | |
|---|---|---|---|
| 3,115,380 | 12/1963 | Kuehl et al. | 439/281 |
| 3,166,371 | 1/1965 | Brown et al. | 439/281 |
| 3,678,441 | 7/1972 | Upstone et al. | 439/272 |
| 3,792,416 | 2/1974 | Moulin | 439/274 |
| 4,090,759 | 5/1978 | Herrmann, Jr. | 339/60 M |
| 4,138,183 | 2/1979 | Soos | 439/272 |
| 4,299,431 | 11/1981 | Wilson et al. | 439/281 |
| 4,349,241 | 9/1982 | Juris et al. | 339/143 R |
| 4,420,210 | 12/1983 | Karol et al. | 339/94 M |
| 4,560,219 | 12/1985 | Chapelot | 439/272 |
| 4,611,873 | 9/1986 | Punako et al. | 339/94 M |
| 4,662,692 | 5/1987 | Uken et al. | 339/96 |
| 4,711,509 | 12/1987 | Cross et al. | 439/587 |
| 4,806,123 | 2/1989 | Konishi et al. | 439/595 |
| 4,921,437 | 5/1990 | Cooper et al. | 439/275 |
| 5,240,433 | 8/1993 | Kato | 439/587 |
| 5,266,045 | 11/1993 | Yamamoto et al. | 439/275 |
| 5,535,512 | 7/1996 | Armogan | 439/936 |
| 5,545,062 | 8/1996 | Takagishi | 439/877 |
| 5,580,266 | 12/1996 | Shelly | 439/281 |
| 5,595,496 | 1/1997 | Konda et al. | 439/271 |
| 5,609,496 | 3/1997 | Kilmer et al. | 439/271 |
| 5,618,206 | 4/1997 | Sawada et al. | 439/587 |
| 5,720,629 | 2/1998 | Self, Jr. et al. | 439/587 |

FOREIGN PATENT DOCUMENTS

WO 87/05157 8/1987 WIPO .

*Primary Examiner*—Paula Bradley
*Assistant Examiner*—Tho D. Ta

[57] ABSTRACT

The invention is directed to an electrical connector assembly with a plug housing having a contact receiving cavity with a forward mating end. A first contact has a forward seal thereon. The forward seal has two sealing portions. A first sealing portion engages the contact receiving cavity and forms a seal therewith, the second portion extends into the forward mating end, there is a space between the second portion and the housing. A receptacle housing has a contact receiving cavity and a forward. The forward end of the receptacle housing is received within the forward mating end of the plug housing in the space between the second portion of the forward seal and the plug housing. The second portion of the seal engages the forward end of the receptacle housing to form a seal therewith.

18 Claims, 5 Drawing Sheets

SEALED ELECTRICAL CONNECTOR

FIELD OF THE INVENTION

The invention relates to an electrical connector assembly which is sealed to prevent entry of water and contaminants into the interior of the connectors.

BACKGROUND OF THE INVENTION

Electrical connectors are often used in environments where they are exposed to dust and dirt, and may even be used in environments where they are subject to splash or immersion in water. The connectors are often used in assemblies wherein the assembly is filled with a potting material which will cover the rear entry of the electrical connector. It is necessary to prevent the entry of the contaminants or the potting material into the interior of the electrical connector. When these contaminants enter an electrical connector housing, contacts in the housing may be coated with contaminants, corroded by oxidation, or covered with the potting material, thereby leading to intermittent and unreliable electrical connections. Many types of seals are known to keep contaminants from entering an electrical connector housing.

U.S. Pat. No. 5,720,629 discloses an electrical connector having a seal member to seal the rear of the electrical connector or the wire entry portion of the electrical connector. The assembly also has an interfacial seal which is received between the mating face of the electrical connector and its mating electrical connector. The interfacial seal is compressed upon mating of the two electrical connectors to provide protection against entry of contaminants into the electrical connector assemblies at the mating interface.

One problem associated with the prior electrical connectors is that the sealed electrical connector must be assembled. Both the wiring entry seal and the interfacial seal must be assembled to the electrical connector housing. What is needed is a sealed electrical connector assembly whereby extra assembly is not necessary.

SUMMARY OF THE INVENTION

The invention is directed to an electrical connector comprising a housing having a contact receiving cavity therein. The cavity has a rear wire seal area and a forward mating area. A contact is secured within the cavity. The contact has a rear seal molded to the contact and a forward seal molded to the contact. The forward seal has two sealing areas, one of the sealing areas engaging the cavity to seal the cavity, the other of the sealing areas extending into the forward mating area and being accessible to engage and seal against the mating connector.

The invention is further directed to an electrical connector assembly with a plug housing having a contact receiving cavity with a forward mating end. A first contact is to be received within the contact receiving cavity. The first contact has a forward seal thereon. The forward seal has two sealing portions. A first sealing portion engages the contact receiving cavity and forming a seal therewith, the second portion extends into the forward mating end. A receptacle housing has a contact receiving cavity and a forward end. A second contact is to be received in the receptacle housing contact receiving cavity. The forward end of the receptacle housing is engagable with the second portion of the forward seal and the plug housing. The second portion of the seal engages the forward end of the receptacle housing to form a seal therewith.

The invention is further directed to electrical connector comprising a contact having a mating end and a termination end, a central section being disposed therebetween. A housing has a contact receiving cavity into which the contact will be secured. The housing has a rear entry and a forward mating section. The contact has a seal disposed on the central section to seal the contact receiving cavity between the rear entry and the forward mating section.

BRIEF DESCRIPTION OF THE DRAWINGS

An embodiment of the present invention will now be described with reference to the accompanying drawings, in which.

DETAILED DESCRIPTION OF EMBODIMENTS OF THE INVENTION

Figure 1:
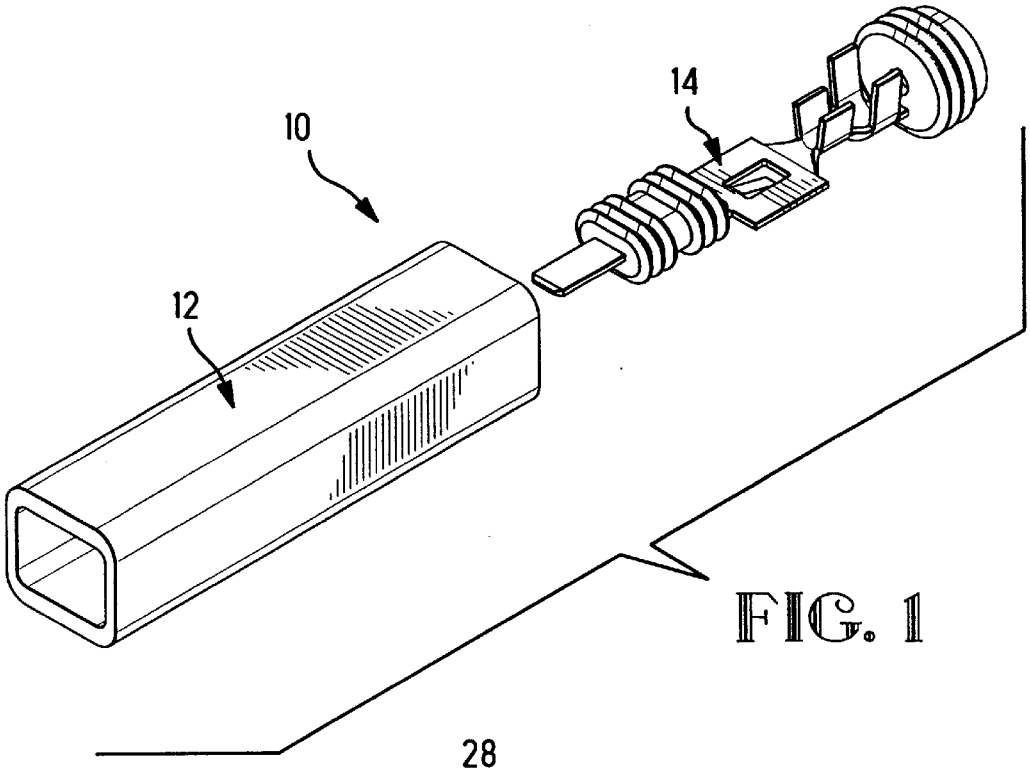
FIG. 1 an exploded isometric view of the plug connector assembly of the present invention.

The present invention is directed to a plug and receptacle electrical connector assembly which is sealed against the environment. FIG. 1 shows an exploded view of the plug assembly 10. The plug assembly 10 is made up of a plug housing 12 and a plug contact 14. The plug housing 12 is illustrated generically in the figures and it is to be understood that different general configurations can be used. For example, the plug housing 12 may have latches or flanges in order to secure the plug housing 12 to the mating housing or to a panel or may have different shapes depending on the specific use of the assembly.

Figure 2:
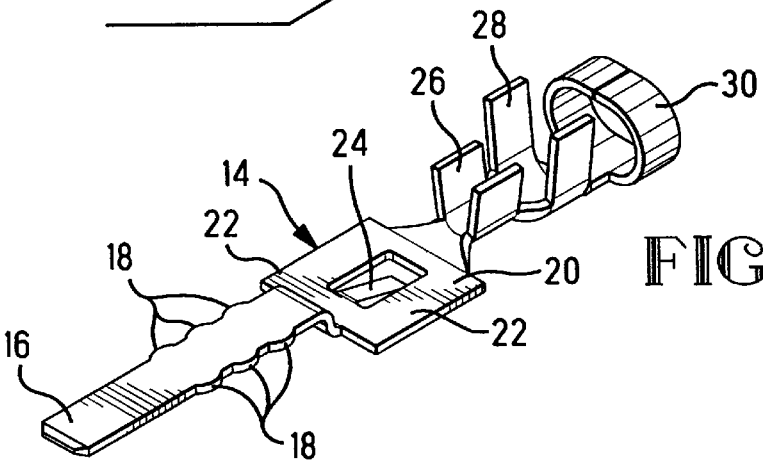
FIG. 2 is an isometric view of the plug contact.

FIG. 2 shows the plug contact 14 prior to having the seals molded thereto. The plug contact 14 has a tab 16 for providing contact with the mating connector. The plug contact 14 also has protrusions 18 to provide a gripping surface for the seal 32. In the central portion of the plug contact 14 there is a flat section 20 which has guide shoulders 22 along either side. The guide shoulders 22 will be used for alignment and support in the plug housing 12. The flat portion 20 also has a locking lance 24 stamped therefrom to secure the contact 14 within the housing 12. The contact 14 has wire crimped barrel 26 and insulation crimp 28 to secure the contact 14 to an insulated wire, not shown, in a manner well known in the art. Rearwardly of the insulation crimp 28 is a seal support 30. The seal support is shown having a basic cylindrical shape, the seal support 30 can be designed in a variety of configurations to provide support for the seal 34.

Figure 3:
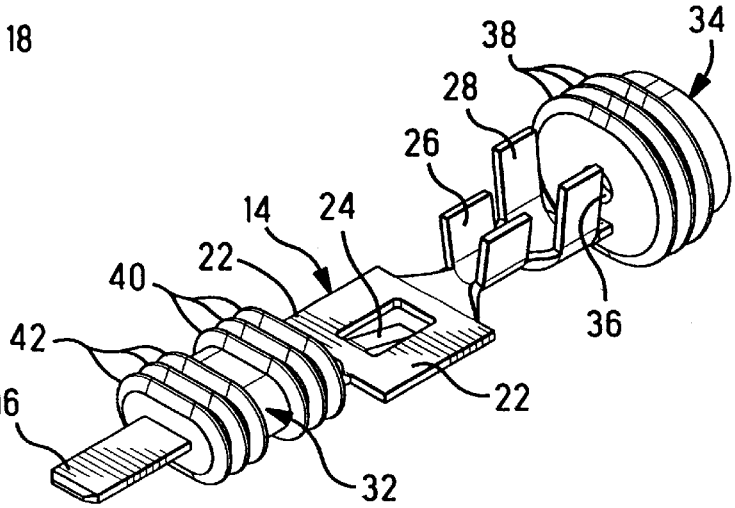
FIG. 3 is an isometric view of the plug contact with seals.

FIG. 3 shows the plug contact 14 having the seals 32, 34 molded thereon. The seals are insert molded over the contacts 14. Seal 32 is molded over the tab portion 16 of the contact 14 so that the seal 34 is received over the protrusions 18. The protrusions 18 will prevent movement of the seal 32 along the tab 16. While the contact 14 is shown having embossments 18 to prevent the seal 32 from moving along the contact 14, other features could also be used to keep the seal 32 in the proper position, for example, holes, indents or arms would all serve the same purpose of keeping the seal 32 properly positioned.

Seal 34 is molded over the rear seal support 30. The rear seal 34 has a circular opening 36 extending therethrough in order to receive the wire which will be crimped to the contact 14. The seal 34 has series of ribs 38 to provide a sealing surface against the plug housing 12. The seal 32 has two sections of ribs 40, 42. The ribs 40 form a first seal area which will seal the internal portion of the plug housing 12. The ribs 42 form a second seal area which will be used to engage the receptacle housing 68 and form a seal therewith.

Figure 4:
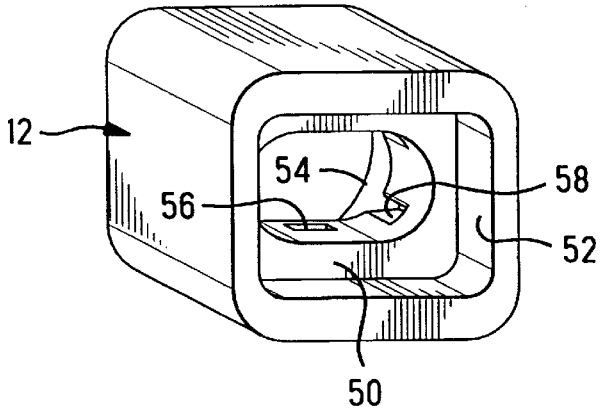
FIG. 4 is a forward isometric view of the plug housing showing the front of the housing.
Figure 5:
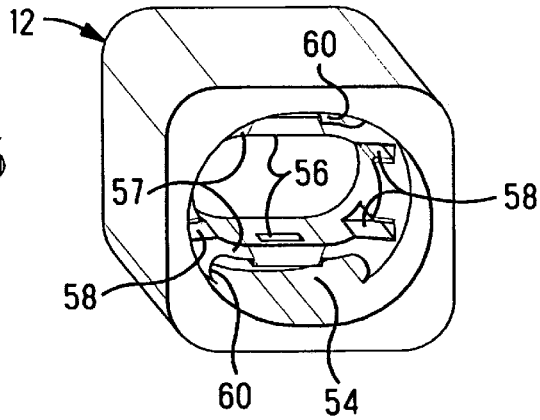
FIG. 5 is an isometric view showing the rear of the plug housing.

FIG. 4 shows a front view of the plug housing 12. The plug housing 12 has a contact receiving cavity 50 extending therethrough that has a forward mating area 52 and a rearward seal area 54, which is best seen in FIG. 5. The plug housing 12 has a latch 56 and guide grooves 58. The housing 12 has four guide grooves 58, two disposed along a bottom portion of the cavity 50 and two disposed along the upper portion of the cavity 50, as seen in FIG. 5.

FIG. 5 shows a rear view of the plug housing 12. Below each of the latching portions 56 are void cores 60. The void cores 60 are designed to allow the portion of the housing with the latching section 56 to flex following molding of the housing. This allows the core pin which will form the latch 56 to be pulled out of the cavity once the material has hardened without destroying the material in front of the latching section 56. As the core pin is removed, the housing portion 57 will flex so that the core pin will not gouge out the material from the housing.

The plug housing 12 is designed to be able to receive the plug contact 14 in either orientation, that is either having the guide shoulders 22 received in the lower guide grooves 58 or the upper guide grooves 58.

Figure 6:
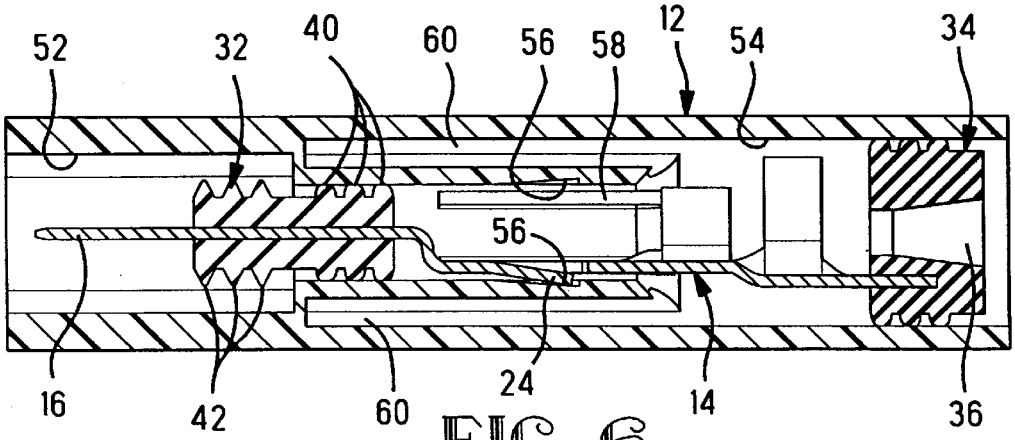
FIG. 6 is a cross-sectional view of the plug housing.

FIG. 6 shows a cross sectional view of the plug contact 14 secured within the plug housing 12. When the contact 14, with the seals 32, 34, is inserted within the housing 12, the guide shoulders 22 are received within the guide grooves 58. The locking lance 24 is received within the latch 56. The interfacial seal 32 is received toward the front of the housing 12 so that ribs 40 engage along the walls of the cavities and ribs 42 extend into the mating area 52 of the housing 12. The ribs 42 do not engage walls of the forward mating area 52, instead there is room around the ribs 42 to receive the receptacle housing 68. The rear seal 34 will engage the inner walls of the rearward seal area 54 to provide a seal thereabout. While a wire is not shown inserted through the hole 36 and the seal 34, it is to be understood that a wire would be inserted through the hole 36 and terminated to the contact 14 thereby providing a good seal around both the wire and the housing 12.

While the plug housing 12 is shown having a shroud, or the forward mating end of the housing 12, extend around the tab 16 on the contact 14, the plug housing 12 could also be designed without the shroud surrounding the tab 16. In that case, the tab 16 and the seal 32 would extend out of the front of the plug housing 12 and be accessible to seal against the receptacle housing 68.

Figure 7:
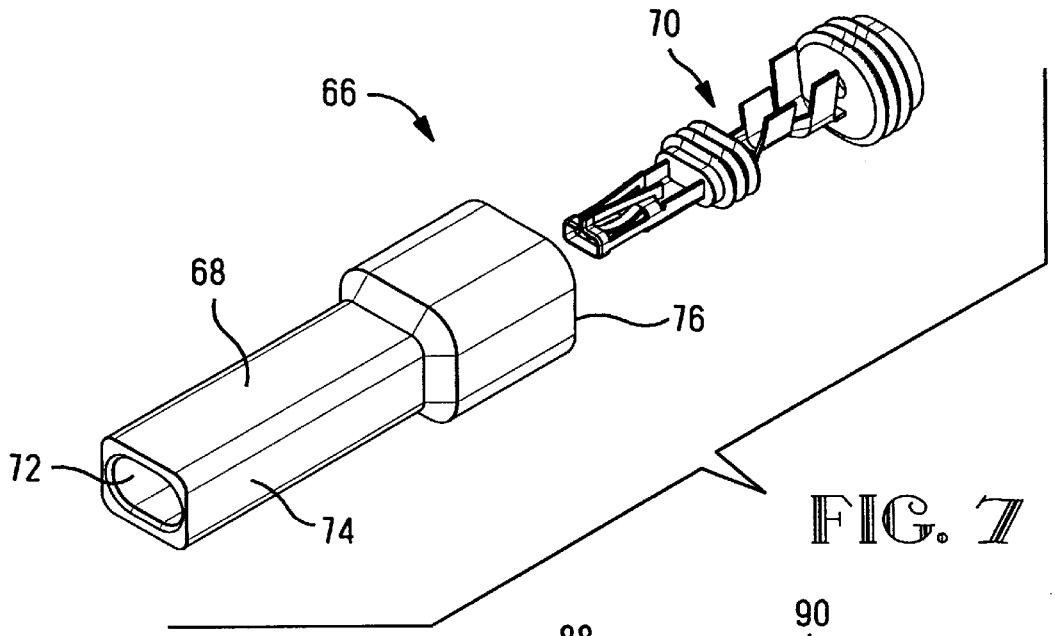
FIG. 7 is an exploded isometric view of the receptacle connector assembly.

FIG. 7 shows an exploded view of the receptacle connector assembly 66 having a housing 68 and the receptacle contact 70. The receptacle housing 68 has a contact receiving cavity 72 extending therethrough. The receptacle housing 68 is shown generically in the figures, however it can be designed in any number of configurations, for example it can have latching arms to mate with the plug housing 12 or latching arms to secure it to a panel or other typical electrical connector housing features. The receptacle housing 68 has a mating end 74 and a rearward end 76 through which the contact 70 will be inserted.

Figure 8:
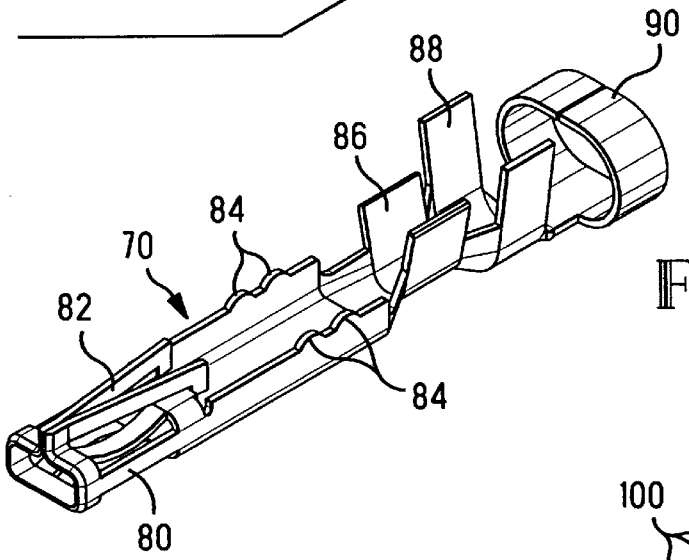
FIG. 8 is an isometric view of the receptacle contact.

FIG. 8 shows an isometric view of the receptacle contact 70 without the seals in place. The receptacle contact 70 has a forward mating end 80 with a latch 82 which is a receptacle and latch combination. The contact is shown in co-pending patent application Ser. No. 08/994,404, which is herein incorporated by reference. In the mid portion of the contact 70 there are protrusions 84 which will prevent movement of the overmolded seal 92 along the contact 70. The contact 70 has wire crimp 86 and insulation crimp 88. The contact 70 has a rear seal support 90 which is similar to the seal support on the plug contact 30. The rear seal support can be designed in various configurations to provide strength and support to the rear seal.

Figure 9:
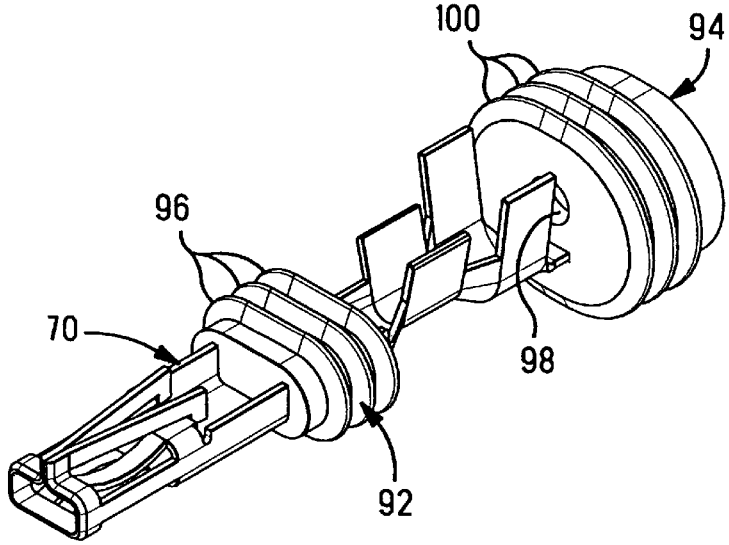
FIG. 9 is an isometric view of the receptacle contact with seals.

FIG. 9 shows the receptacle contact 70 with the seals 92 and 94 in place. The seal 92 has ribs 96 to provide a good sealing interface with the interior of the plug housing 68. The rear wire seal 94 has an opening 98 to allow insertion of the wire therethrough and ribs 100 to provide a good seal against the interior of the receptacle housing 68. Seal 92 is insert molded over the portion of the contact 70 having the embossments 84 in order to prevent the seal 92 from slipping on the contact 70. While the contact 70 is shown having embossments 84 to prevent the seal 92 from moving along the contact 70, other features could also be used to keep the seal 92 in the proper position, for example, holes, indents or arms would all serve the same purpose of keeping the seal 92 properly positioned. The rear wire seal 94 is molded over the seal support 90. The seal support 90 provides structural support for the seal 94.

Figure 10:
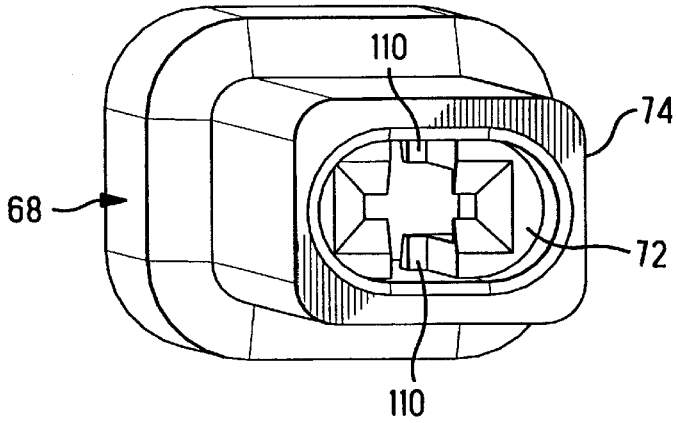
FIG. 10 is an isometric showing the front of the receptacle housing.
Figure 11:
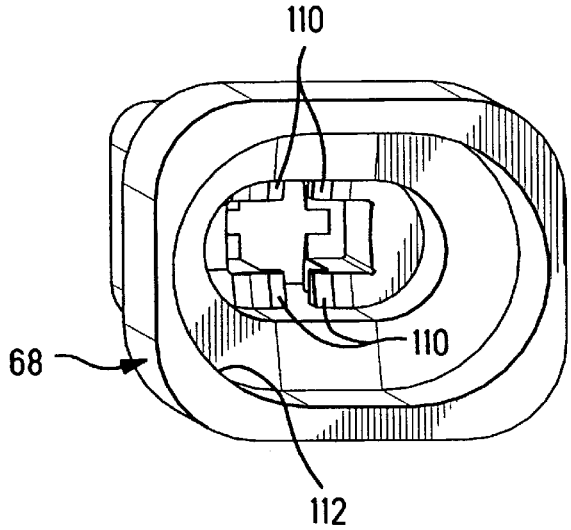
FIG. 11 is an isometric view showing the rear of the receptacle housing.

FIG. 10 shows a front view of the receptacle housing 68 showing the contact receiving cavity 72 and the mating portion 74. The contact receiving cavity has latching protrusions 110 on both the bottom and the top of the contact receiving cavity to allow latching of the contact 70 in either orientation within the contact receiving cavity 72. The housing and the latching features are shown in co-pending patent application Ser. No. 08/994,404. FIG. 11 shows the rear of the housing 68 and the wire seal area 112. FIG. 11 shows the arrangement of all four of the latching protrusions 110.

Figure 12:
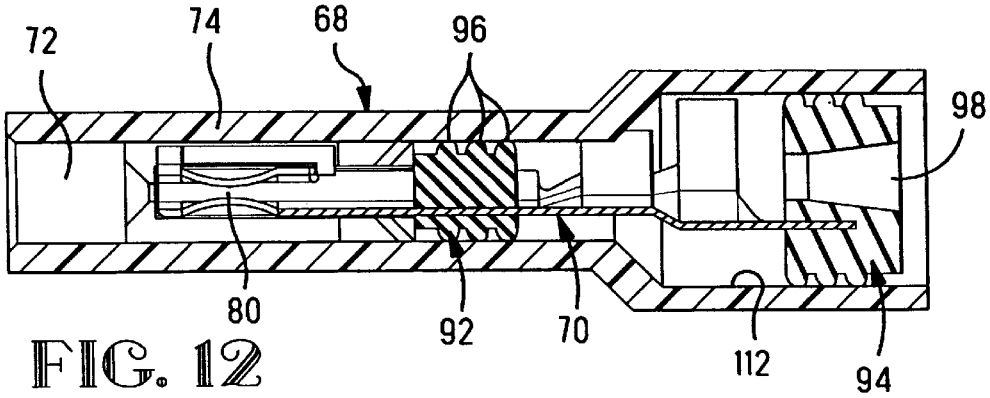
FIG. 12 is a cross sectional view of the receptacle assembly;.

FIG. 12 is a cross-sectional view of the receptacle housing 68 having the insert molded contact 70 secured therein. The rear seal 94 is received in the wire seal area 112 of the housing 68 and the forward seal 92 is received in mating end 74 of the housing 68. The forward seal 92 is used when the receptacle housing 68 is used in an application where the assembly would be potted and the rear of the housing 68 will be exposed to the potting material. If the assembly will not be used in the potted configuration, the forward seal 92 is not necessary for just a sealed connector application.

Figure 13:
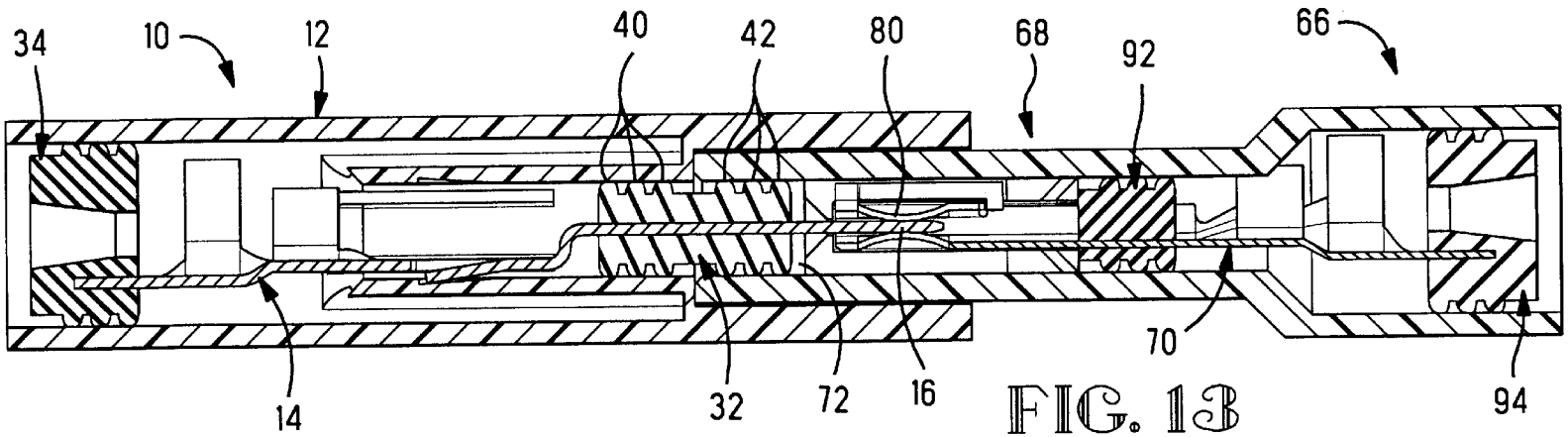
FIG. 13 is a cross-sectional showing the mated assemblies

FIG. 13 shows a cross-sectional view of the plug and receptacle assemblies 10, 66 mated to each other. When the assemblies are mated together, the mating portion 74 of the receptacle housing 68 is received within the forward mating area 52. The tab 16 of the contact 14 is mated with the mating end 80 of contact 70.

In this view it can be seen that the ribs 42 on the forward portion of the seal 32 are received within the mating portion 74 of the receptacle housing 68 to provide a sealing interface therewith. The seal 32 provides an interfacial seal between the mating connector assemblies 10, 66 in that if moisture or other contaminants are received in the interface, the seal 32 will prevent it from entering either the receptacle housing 68 or the plug housing 12. The rear seals 34, 94 will provide protection to the interior of the assembly from the wire entry portion of the housings.

Figure 15:
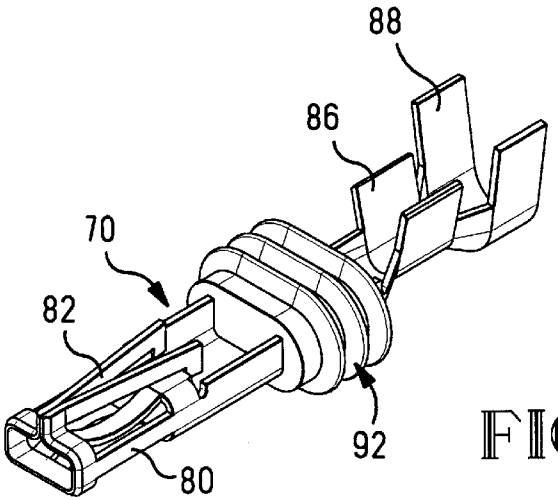
FIG. 15 is an isometric view of another alternative embodiment of the receptacle contact.
Figure 14:
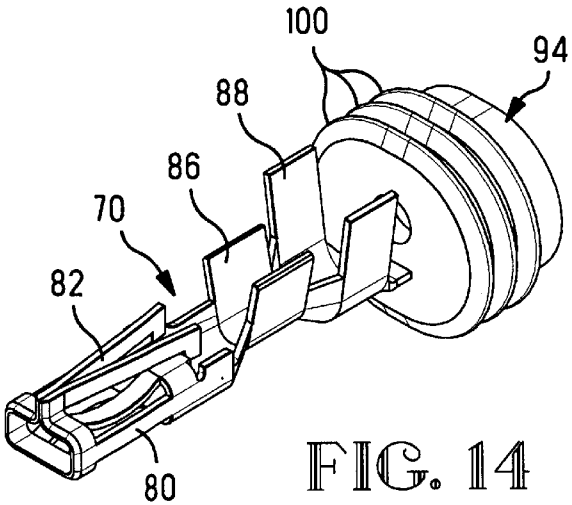
FIG. 14 is an isometric view of an alternative embodiment of the receptacle contact.

While the receptacle contact 70 has been shown having two seals 92, 94, the receptacle contact 70 need only have one or the other of the seals, as shown in FIGS. 14 and 15, in which like parts will have the same reference numbers. FIG. 14 shows a receptacle contact 70 having only a rear seal 94. The rear seal 94 is similar to the seal shown in FIG. 9. The receptacle contact 70 shown in FIG. 14 would be used in a connector assembly in which a fully sealed connector is needed. The rear seal 94 will provide a seal against the wire entry portion of the receptacle housing 68 and the seal 94 on the plug housing will provide the interfacial seal. Therefore, the assembly will be completely sealed.

In other requirements, only the center seal 92 will be needed. This will be the case where the receptacle housing 68 will be used in a potted application. That is, an application where the rear of the connector housing 68 will be exposed to foam or a potting material. In this application, it is only necessary to prevent the potting material from entering the contact area of the housing 68 and contaminating the contact area 80 of the contact 70. It will not matter if the rear of the contact, or the crimping areas 86, 88, is exposed to the potting material. FIG. 15 shows the receptacle contact 70 having a center seal 92. The center seal 92 will prevent the potting material from going from the rear of the receptacle housing 68 to the front of the receptacle housing 68. While the seal 92 is shown having ribs 96 on its outer surface, the seal 92 may be designed in various configurations, including a plain cylindrical shape, since the potting material is much more viscous than water, it need not provide as good of a seal against the housing 68.

The contacts are being described as tab and receptacle contacts, but it is to be understood that the contacts can be other types of contacts such as pin and receptacle, or resilient finger contacts. Alternatively, the seal 32, having two sealing areas, can be insert molded onto the other of the mating contact, the receptacle contact 70 in the specific example shown.

The sealed assembly provides protection against contamination in the interior of the assemblies using only one interfacial seal and two wire entry seals. The fourth seal 92 is only needed for applications where the receptacle housing is used in an arrangement where the rear of the receptacle housing will be exposed to a potting or foam material. The seals are disposed on the contacts so that no additional assembly of the seals to the housings are necessary.

It is felt that the electrical connector of the present invention and many of its attendant advantages will be understood from the foregoing description. It is apparent that varies changes may be made in the form, construction, and arrangement of parts thereof without departing from the spirit or scope of the invention, or sacrificing all of its material advantages.

What is claimed is:

1. An electrical connector, comprising:

a housing having a contact receiving cavity therein, the cavity having a forward mating area;

a contact secured within the cavity, the contact having a rear seal molded to the contact and a forward seal molded to the contact, the forward seal being spaced from the rear seal, the forward seal having two sealing areas, one of the sealing areas engaging the cavity to seal the cavity, the other of the sealing areas extending into the forward mating area and being accessible to engage and seal against a complementary mating connector, upon being mated thereto.

2. The electrical connector of claim 1, wherein the contact has a seal support, the rear seal being molded over the seal support and the seal support provide structural support for the rear seal.

3. The electrical connector of claim 1, wherein a shroud extends around the contact and there is a space between the seal and the shroud to allow the mating connector to engage the seal.

4. The electrical connector of claim 1, wherein the contact has a tab for mating with a contact in the mating connector.

5. The electrical connector of claim 4, wherein the contact has a holding feature and the forward seal is molded over the holding feature, the holding feature preventing the forward seal from moving along the contact.

6. The electrical connector of claim 1, wherein the contact has guide shoulders and the housing has guide grooves, the guide shoulders being received within the guide grooves to align the contact within the housing.

7. The electrical connector of claim 6, wherein the housing has two sets of guide grooves, one along each side of the housing so that contact can be inserted into the housing in either orientation.

8. An electrical connector assembly, comprising:

a plug housing having a contact receiving cavity with a forward mating end;

a first contact to be received within the contact receiving cavity, the first contact having both a rear seal and a forward seal molded thereon, the forward seal being spaced from the rear seal, the forward seal being molded over a retention feature of the contact thereby preventing the forward seal from moving along the first contact, the forward seal having two sealing portions, a first sealing portion engaging the contact receiving cavity and forming a seal therewith, the second sealing portion extending into the forward mating end and being accessible to engage and seal against a mating connector;

a receptacle housing having a contact receiving cavity and a forward end;

a second contact to be received in the receptacle housing contact receiving cavity;

the forward end of the receptacle housing being engagable with the second sealing portion of the forward seal, the second sealing portion of the forward seal engaging the forward end of the receptacle housing to form a seal therewith.

9. The electrical connector assembly of claim 8, wherein the first contact has a tab for mating with the second contact.

10. The electrical connector assembly of claim 8, wherein the first contact has a seal support, the rear seal being molded over the seal support, the seal support providing structural support for the rear seal.

11. The electrical connector assembly of claim 8, wherein each of the first contact and the second contact have rear seals disposed over seal supports, the rear seals engaging the plug and the receptacle housings to provide rear entry seals.

12. The electrical connector assembly of claim 8, wherein the first contact has guide shoulders and the plug housing has guide grooves, the guide shoulders being received within the guide grooves to align and secure the first contact within the plug housing.

13. The electrical connector assembly of claim 12, wherein the plug housing has two sets of guide grooves, one along each side of the plug housing so that first contact can be inserted into the housing in either orientation.

14. An electrical connector assembly, comprising:

a plug housing having a contact receiving cavity with a forward mating end;

a first contact to be received within the contact receiving cavity, the first contact having both a rear seal and a forward seal molded thereon, the forward seal being spaced from the rear seal;

the rear seal being molded over a seal support on the contact thereby providing structural support for the real seal;

the forward seal having two sealing portions, a first sealing portion engaging the contact receiving cavity and forming a seal therewith, the second sealing portion extending into the forward mating end and being accessible to engage and seal against a mating connector;

a receptacle housing having a contact receiving cavity and a forward end;

a second contact to be received in the receptacle housing contact receiving cavity;

the forward end of the receptacle housing being engagable with the second sealing portion of the forward seal, the second sealing portion of the forward seal engaging the forward end of the receptacle housing to form a seal therewith.

15. The electrical connector assembly of claim 14, wherein the first contact has a tab for mating with the second contact.

16. The electrical connector assembly of claim 14, wherein each second contact has a rear seal disposed over a seal support, the rear seals of the first and second contacts engaging the plug and receptacle housings respectively to provide rear entry seals.

17. The electrical connector assembly of claim 14, wherein the first contact has guide shoulders and the plug housing has guide grooves, the guide shoulders being received within the guide grooves to align and secure the first contact within the plug housing.

18. The electrical connector assembly of claim 17, wherein the plug housing has two sets of guide grooves, one along each side of the plug housing so that first contact can be inserted into the housing in either orientation.

* * * * *